US006437676B1

(12) United States Patent
Takeda et al.

(10) Patent No.: US 6,437,676 B1
(45) Date of Patent: Aug. 20, 2002

(54) INDUCTANCE ELEMENT

(75) Inventors: Kazuhiro Takeda; Kuniaki Kiyosue; Hiromi Sakita; Masanobu Kuroki; Mitsuo Kanmera; Kenzo Isozaki, all of Miyazaki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/591,315

(22) Filed: Jun. 9, 2000

(30) Foreign Application Priority Data

Jun. 29, 1999 (JP) ..... 11-182870
Jun. 29, 1999 (JP) ..... 11-182871

(51) Int. Cl.[7] ..... H01F 27/29
(52) U.S. Cl. ..... 336/192; 336/83; 336/200
(58) Field of Search ..... 336/180, 184, 336/196, 200, 206, 83, 192; 29/602.1

(56) References Cited

U.S. PATENT DOCUMENTS

| | | | | |
|---|---|---|---|---|
| 4,696,100 A | * | 9/1987 | Yamamoto et al. | 336/192 |
| 5,457,872 A | * | 10/1995 | Sakata et al. | 336/192 |
| 5,945,902 A | * | 8/1999 | Lipkes et al. | 336/200 |
| 5,963,119 A | * | 10/1999 | Takeda et al. | 336/206 |
| 6,060,977 A | * | 5/2000 | Yamamoto et al. | 336/212 |
| 6,144,280 A | * | 11/2000 | Amada et al. | 336/192 |

FOREIGN PATENT DOCUMENTS

| | | | |
|---|---|---|---|
| JP | 62-46247 | | 12/1982 |
| JP | 58-155714 | | 9/1983 |
| JP | 61-144616 | | 9/1986 |
| JP | 3-1510 | | 1/1991 |
| JP | 4-101404 | | 4/1992 |
| JP | 8-124748 | | 5/1996 |
| JP | 8-124749 | | 5/1996 |
| JP | 8-181021 | | 7/1996 |
| JP | 8-213248 | | 8/1996 |
| JP | 9-306744 | | 11/1997 |
| JP | 3049201 | | 3/1998 |
| JP | 10-116730 | | 5/1998 |
| JP | 10-125536 | * | 5/1998 |
| JP | 10-163040 | | 6/1998 |
| JP | 10-172832 | | 6/1998 |
| JP | 11-40424 | | 2/1999 |
| JP | 11-087127 | | 3/1999 |

OTHER PUBLICATIONS

Handbook of Epoxy Resin (Published Dec. 25, 1987) (separate English explanation).

* cited by examiner

*Primary Examiner*—Lincoln Donovan
*Assistant Examiner*—Tuyen T. Nguyen
(74) *Attorney, Agent, or Firm*—McDermott, Will & Emery

(57) ABSTRACT

An inductance element providing a high Q factor even with a dawn-sized configuration comprises a column shape body (7), a coil (13) wound around the body (7), a terminal electrode provided at both ends of the body (7), connected with the coil (13), and a protection material (16) for covering the coil (13), which has a relative dielectric constant not higher than 6.0.

18 Claims, 10 Drawing Sheets

INDUCTANCE ELEMENT

BACKGROUND OF THE INVENTION

The present invention relates to an inductance element for use in a mobile communication equipment, power supplies and other electronic apparatus.

An example of conventional inductance elements is described in Japanese Utility Model Laid-Open No. S61-144616: a chip coil shown in FIG. 12 perspective view. The chip coil is composed of a body 1 provided with flanges 2, 3 at both ends of a winding area 4, and a coil 6 wound around the body 1. The flanges 2, 3 are provided with a cut 5 for holding the end portion of the coil 6, respectively. Since a chip coil of the above configuration is free from the polarity, the efficiency of mounting the chip coil on a circuit board is high; therefore, the productivity in circuit board manufacture is increased. Furthermore, since the coil 6 does not protrude above the flange surface, or the surface of connection, it has a superior surface mounting stability.

Other examples of conventional inductance elements, composed of a body and a coil wound around the body, are disclosed also in, for example, Japanese Patent Laid-Open Nos. H8-124748, H8-124749, H8-213248 and H9-306744, and Japanese Utility Model Laid-Open No. H3-1510. Japanese Patent Laid-Open No. H10-172832 discloses an inductance element that is provided with a tapered portion between the winding region to be wound by a coil and the flanges functioning as terminals disposed at both ends.

However, in the above-described configuration, where the wire diameter of a coil is compelled to go less and less along with the down-sizing of an inductance element, deterioration in the Q factor is significant.

Further problem with the above-described conventional inductance elements is that it is not easy to judge by an image recognition process whether an inductance element is acceptable or is to be rejected, since the terminals at both ends of body is normally colored silver, and color of the body is normally white. Recognition errors often arise at the judgement, ill-affecting the productivity.

The present invention addresses the above problems, and aims to offer an inductance element that is a coil-type and yet provides an improved Q factor and other characteristics even with a down-sized configuration.

Another objective of the present invention is to offer an inductance element with which a judgement on the terminal electrodes is performed surely with ease; hence the productivity may be improved with the inductance elements.

SUMMARY OF THE INVENTION

An inductance element of the present invention comprises a column-shaped body, a coil wound around the body, terminal electrodes provided at both ends of the body for connection with the coil and a protection material for covering the coil, which protection material having a relative dielectric constant not higher than 6.0. The Q factor can be improved by the use of a protection material whose relative dielectric constant is not higher than 6.0 in the above-described configuration.

It is preferred in an inductance element of the present invention that the outermost layer of each terminal electrode has a color that is different from the colors of the body and the protection material. The difference in the colors remarkably contributes to reduce the image recognition errors and to improve the productivity. The earlier-described erroneous judgement occurred with the conventional inductance elements seems to have been caused by a recognition error that the terminal electrode has been recognized to be larger than specified dimensions because of an apparent resemblance among the colors of the body and the terminal electrode. The reduced recognition error with the inductance elements of the present invention seems to be a result of the differentiated coloring.

DETAILED DESCRIPTION OF THE INVENTION

Details of exemplary embodiments of an inductance element are described below in accordance with the present invention.

Figure 1:
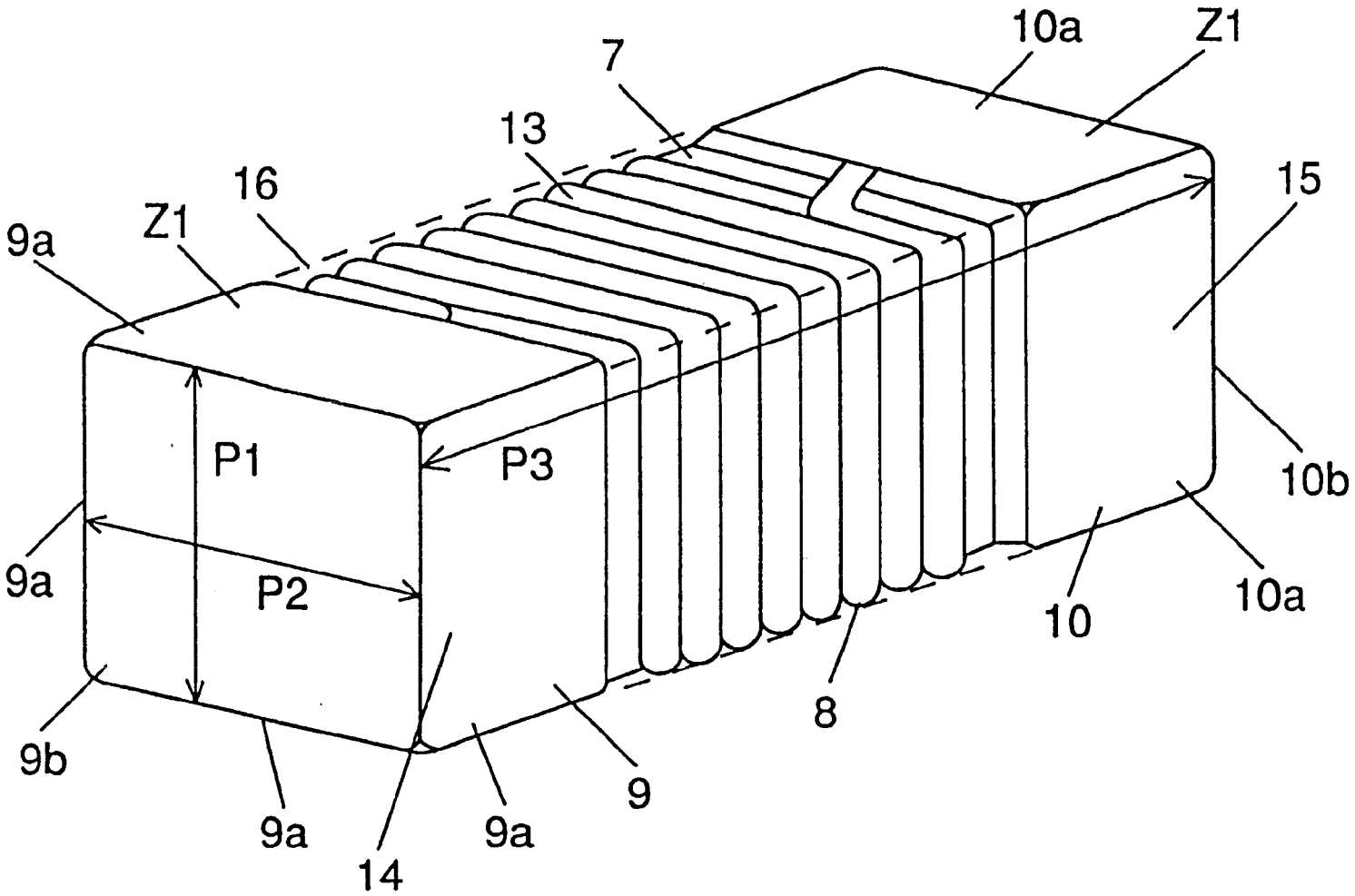
FIG. 1 is a perspective view showing an inductance element in accordance with an exemplary embodiment of the present invention.

As shown in FIG. 1, an inductance element is formed of a body 7 and a coil 13 wound around the body 7. In the first place, the body 7 is described below. The body 7 is made either of a non-magnetic material such as alumina, or a magnetic material such as ferrite. A body 7 of non-magnetic material is suitable for a frequency 100 MHz or higher. A body 7 of said alumina, or a material containing alumina brings about a significant advantage in characteristics and in the manufacturing cost. Whereas, a body 7 of a magnetic material, such as ferrite, leads to an advantage in characteristics, ease of processing and in the cost of manufacture.

It is preferred that the body 7 has a relative dielectric constant not higher than 10.0; more preferably, not higher than 6.0. The self resonant frequency f0 improves, and, as a result, the Q factor improves when the body 7 is provided with a relative dielectric constant not higher than 10.0. Since a fluoric resin is the material that can ensure full functioning of a body 7, the lowest value of relative dielectric constant is preferably 2.4. Namely, the relative dielectric constant should preferably be not less than 2.4.

It is preferred that the body 7 has a specific resistivity not less than $10^{11}$ Ωm; more preferably, not less than $10^{14}$ Ωm.

Figure 10:
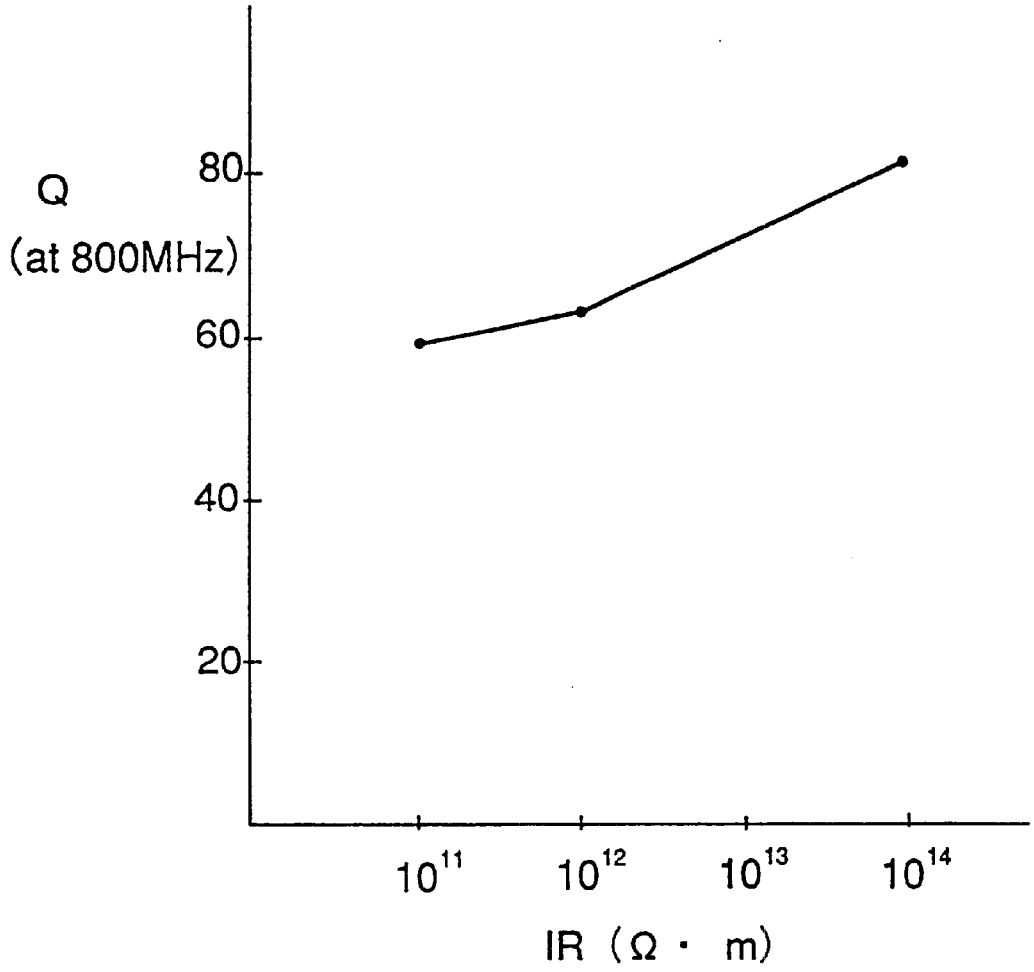
FIG. 10 shows the relationship between specific resistivity IR of the body and Q factor in the inductance element.

By setting the specific resistivity to be not less than $10^{11}\Omega$m, electric current that flows in the body 7 can be curtailed, which leads to an improved efficiency and to an improved Q factor. It is understandable from the graph shown in FIG. 10, where the Q factor is seen picking up in a region where the specific resistivity is not less than $10^{11}$ Ωm. The graph shown in FIG. 10 represents a case where the overall dimensions of an inductance element are; 1.6 mm long, 0.8 mm wide, 0.8 mm high, number of turns of coil 13 are 10 turns, thickness of protection material 16 falls within a range from 70 μm to 80 μm, where, the specific resistivity of the body 7 is varied. The specific resistivity of the body 7 is varied by shifting quantity of alumina, etc.

It is preferred that the body 7 is made of forsterite, mulite, steatite, or the like material containing alumina. A body 7 having a relative dielectric constant not higher than 10.0, or a specific resistivity not less than $10^{11}$ Ωm, may be provided through the use of such a material.

As described in the above, by controlling at least one of the values either the relative dielectric constant or the specific resistivity of body 7 within the above-described range, the lowering trend of the Q factor can be curbed even with significantly down-sized inductance elements. The deterioration of the Q factor is thus prevented.

Figure 2:
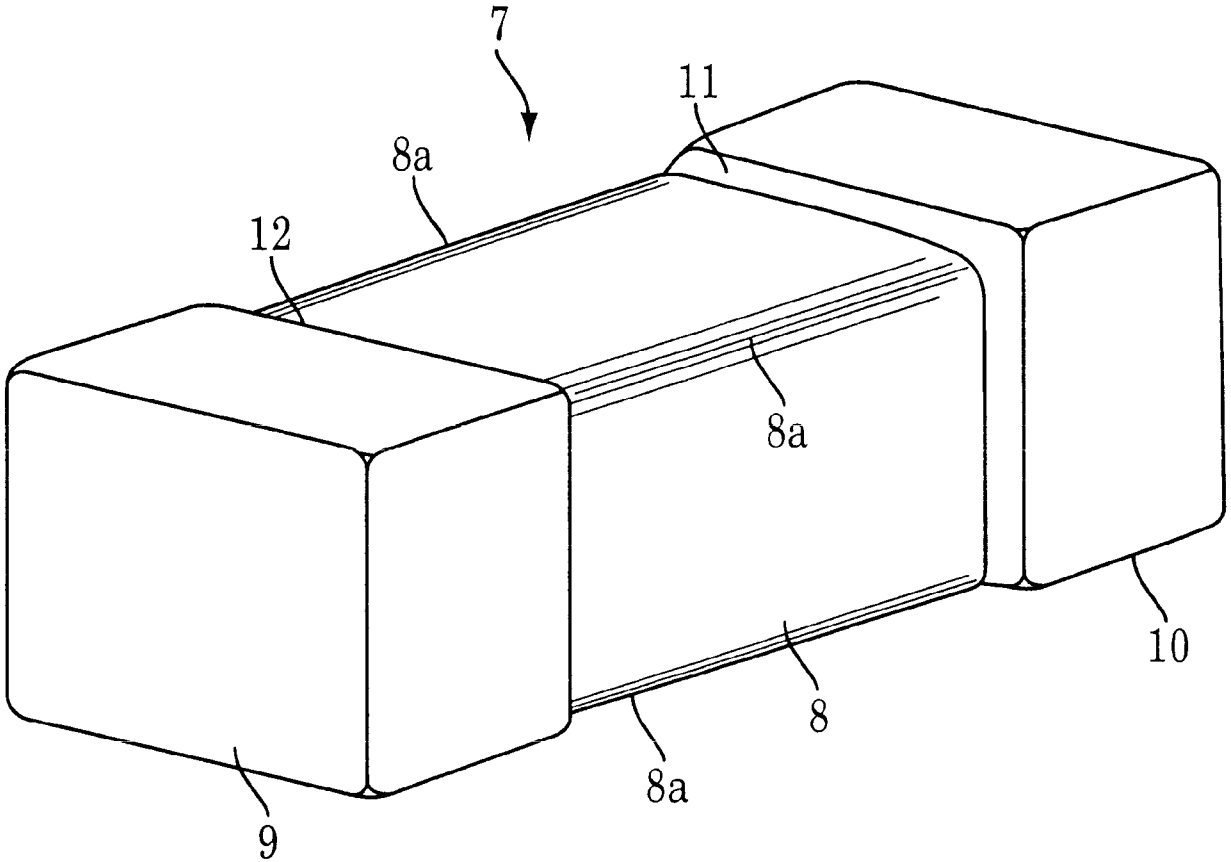
FIG. 2 is a perspective view showing a body of the inductance element.

The shape of body 7 is described next referring to FIG. 2. The body 7 is formed of a winding region 8 for winding a coil 13 around and a flange 9, 10 provided at respective ends of the winding region 8. The winding region 8 and the flange 9, 10, respectively, are approximately cube shaped, whose cross sectional forms are approximate squares. The winding region 8 is leveled a step lower than the flange 9, 10, the diameter being smaller than that of flange 9, 10. It is preferred that side edges 8*a* of the winding region 8 are chamfered or tapered, in view of preventing the wire of coil 13 from getting damaged with the insulation coating during winding operation, such damage would invite short-circuiting. Preferred radius of the rounding at the side edges 8*a* is 0.08 mm–0.15 mm. A small radius not greater than 0.08 mm tends to cause a damage on the coil 13, while a greater radius exceeding 0.15 mm reduces diameter of the coil 13, which would invite deteriorating Q factor.

A sharp side edge 8*a* is effective to enhance the fixing strength of coil 13 wound around the winding region 8 to the side edge 8*a*. This is an advantageous point in preventing a dislocation of coil 13. Therefore, if prevention of the coil dislocation is a more important element than a damage on the coil 13, the side edges 8*a* should be made sharp. When such a configuration is adopted, some additional consideration have to be given, for example, making insulation coating of the coil 13 thicker, using a slightly thicker wire for the coil 13. If such a consideration is introduced, the fixing strength of coil 13 may be enhanced while preventing a damage on the coil 13.

A tapered area 11 provided in the border between the flange 10 and the winding region 8 makes it easy to wind the coil 13 around the winding region 8 and to prevent the coating of wire of coil 13 from getting hurt. With the same concept, a tapered area 12 is provided in the border between the flange 9 and the winding region 8.

The coil 13 may be wound around the winding region 8 with a gap provided between the adjacent wires, or without a wire-to-wire gap. In a coil wound with the wire-to-wire gap, the deterioration in the Q factor, etc. is prevented; while in a coil wound without the gap, the increased number of turns increases the inductance. It is preferred that the coil 13 is formed with a wire made of at least one of the conductive materials among silver, silver alloy, copper, copper alloy, gold, gold alloy, aluminum, aluminum alloy, etc. Copper or copper alloy, among others, seems to be the most preferred, taking the factors of cost, mechanical strength, ease of handling, etc. into consideration.

Figure 3:
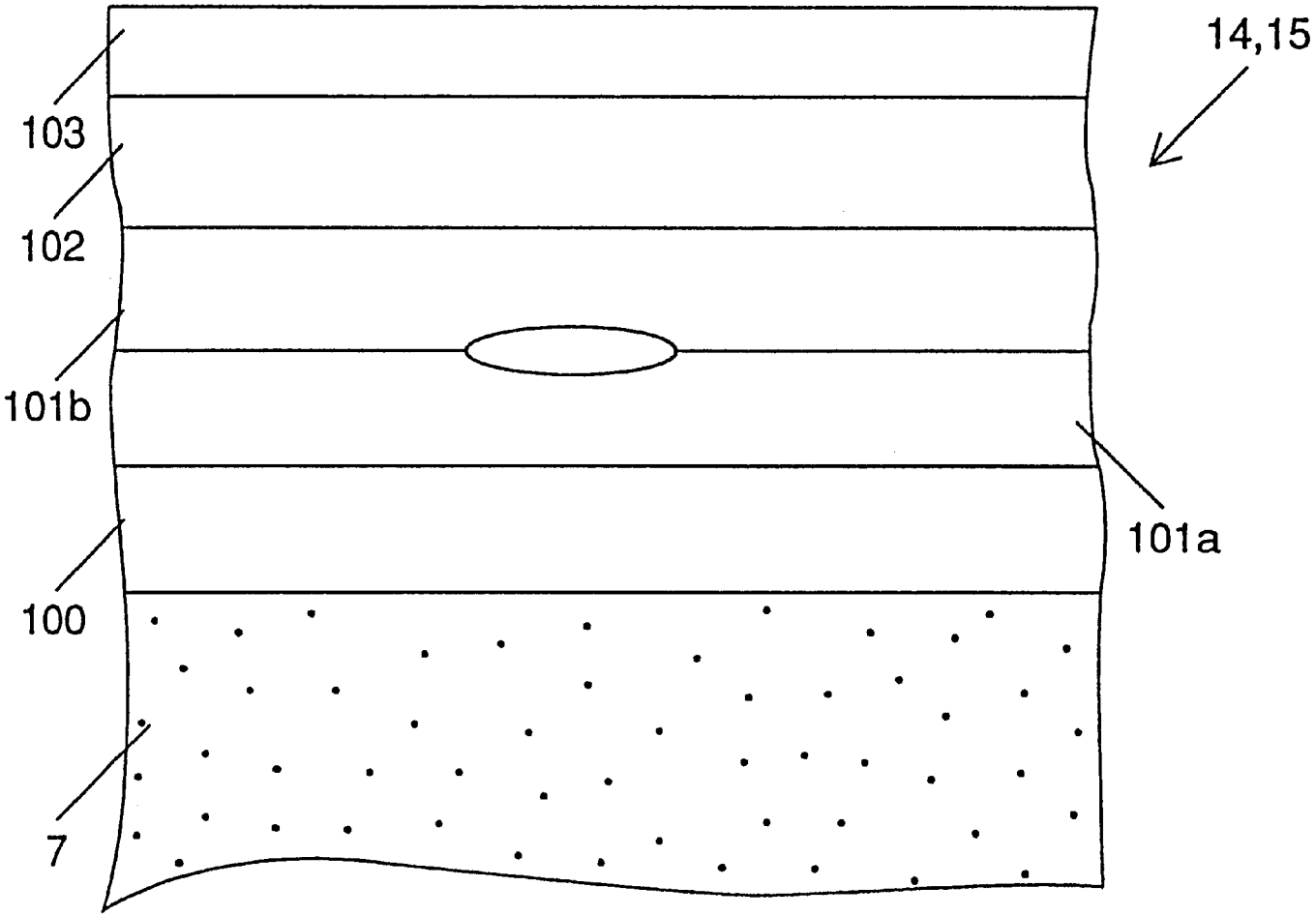
FIG. 3 is a cross sectional view showing the terminal structure of the inductance element.
Figure 4:
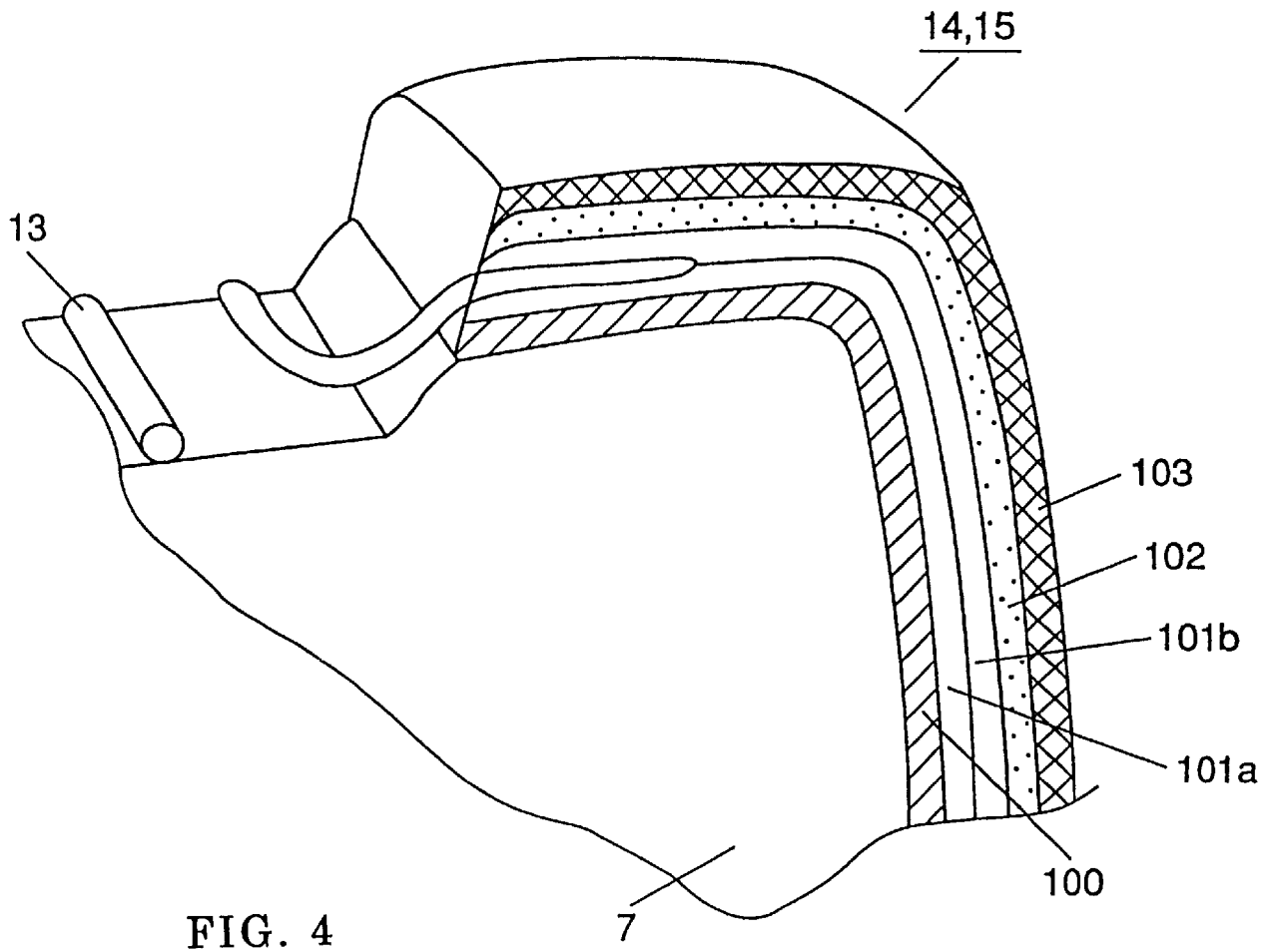
FIG. 4 is a cross sectional view in part showing a region around the terminal of the inductance element.

The terminal section 14, 15 provided on the surface of the flange 9, 10 is formed of a terminal electrode and a connection layer, as illustrated in FIG. 3 and FIG. 4.

The terminal electrode contains an under layer 100 formed on the body 7, a conductive layer 101*a* formed on the under layer 100 and a conductive layer 101*b* stacked on the conductive layer 101*a*. In a case where the body 7 is made of alumina, ferrite or other ceramic material, which is not friendly with the electrolytic plating, an under layer 100 can be provided with ease on the body 7 by either forming an under layer 100 through an electroless plating process, or first applying a conductive paste on the body 7 and then baking it. A thick terminal electrode can be formed within a short time by providing a conductive layer 101*a* on the under layer 100 by electrolytic plating process.

The terminal electrode is structured so that a flattened end of the coil 13 is sandwiched between the conductive layer 101*a* and the conductive layer 101*b*. The above structure significantly enhances the connection strength, and a probability of the coil 13 dropping off the terminal 14, 15 is almost eliminated. In the present exemplary embodiment, both of the conductive layers 101*a* and 101*b* have been made of a material that does not melt at 260° C.

At least the conductive layer 101*b* should preferably be formed of a material that does not melt at 260° C., more preferably 300° C. Namely, the melting point should preferably be not lower than 260° C., more preferably not lower than 300° C. It is also preferred that the material is a metal. In a case where the conductive layer 101*b* is formed with a material that does not melt at 260° C., melting of the conductive layer 101*b* does not occur at a temperature at which any connecting materials normally used for connecting an electronic component or other devices onto the surface of a circuit board melt. This means that it can withstand the reflow soldering process or the like heat treatments, and the coil 13 does not fall off the terminal.

In the present exemplary embodiment, the terminal electrode has been formed with three layers (under layer 100, conductive layer 101*a* and conductive layer 101*b*). However, the terminal electrode may take a two-layered structure, a four-layered structure or even a structure of more number of layers. A two-layered terminal electrode may be formed with, for example, one conductive layer that functions for both the under layer 100 and the conductive layer 101*a*, and a conductive layer 101*b* disposed on the one conductive layer; or in a case where the under layer 100 is not needed, the conductive layer 101*a* and the conductive layer 101*b* may be stacked in the order, direct on the body 7. If it is intended to provide the terminal electrode itself with an anti-weathering property, or to provide a certain protection on the body 7, or to enhance the adhesion strength of the terminal electrode with the body 7, introduction of a multiple layer consisting of more than three layers is preferred.

The under layer 100, the conductive layer 101*a* and the conductive layer 101*b* are formed with a conductive metal such as copper, silver, gold, etc., or conductive metal alloy material such as copper alloy, silver alloy, gold alloy, etc., or these conductive materials added with other elements. Considering the productivity and cost factors, it is remarkably advantageous to first forming an under layer 100 by baking silver or silver alloy together, and then forming a conductive layer 101*a* on the under layer 100 by plating copper or copper alloy through electrolytic plating or the like process. By so doing, the adhesion strength between the body 7 and the terminal electrode can be increased, too.

It is preferred that the conductive layer 101*a* is formed with at least one of the materials among silver, copper, silver alloy, copper alloy, solder, tin, nickel, nickel alloy, gold and gold alloy. It is preferred that the conductive layer 101*b* is formed with at least one of the materials among silver, copper, silver alloy, copper alloy, nickel, nickel alloy, gold, gold alloy, tin-silver alloy, tin-bismuth alloy and tin-silver-bismuth. By forming the conductive layer 101*b* with at least one of the materials among tin-silver alloy, tin-bismuth alloy and tin-silver-bismuth, it realizes a so-called lead-free electronic component that has a remarkably environment-friendly character.

An especially preferred embodiment is forming an under layer 100 by baking silver or silver alloy together, and then forming a conductive layer 101*a* by plating silver or silver alloy on the under layer 100 through electrolytic plating process or the like process. Then, connecting the coil 13 by thermal compression, ultrasonic welding, or the like method on the conductive layer 101*a*, and forming a conductive layer 101*b* with copper or copper alloy, whose melting point is higher than 260° C.

Preferred thickness is; 2 μm–30 μm for the under layer 100, 10 μm–30 μm for the conductive layer 101*a*, 3 μm–100 μm for the conductive layer 101*b*. More preferred thicknesses for the under layer 100, the conductive layer 101*a* and the conductive layer 101*b*, respectively, are; 2 μm–10 μm, 18 μm–22 μm and 20 μm–30 μm.

A connection layer on the terminal electrode may be eliminated in a case where circuit pattern is provided with a solder for electrical connection with an element. In a general case, however, it is preferred to form a connection layer for enhancing the connecting strength with circuit board.

A connection layer is formed of an anti-corrosion layer 102 and a connection surface layer 103. The connection surface layer 103 is indispensable for a connection layer, while the anti-corrosion layer 102 is optional, which may be provided depending on the need. The anti-corrosion layer 102 is formed with nickel (Ni), titanium (Ti), palladium (Pd), or other anti-corrosion metal, or alloy of such metals, through a plating or the like process. The anti-corrosion layer 102 significantly improves anti-corrosive capacity of the terminal electrode. Over the anti-corrosion layer 102, a connection surface layer 103 is formed with a solder or the like conductive connection material using a plating or the like process.

A protection material 16 covering the coil 13 almost entirely except the end portion (ref. FIG. 1) is made of an epoxy resin or the like anti-weathering material. Also, a resist may be used for the protection material 16. Use of a resist makes formation of the protection material 16 easier to an improved productivity. The protection material 16 may be formed also by electrodeposition of a cation system resin or an anion system resin. The electrodeposition method enables application of the protection material 16 on quantities of elements altogether in one process step. This remarkably improves the productivity.

If a protection material 16 is provided covering the coil 13 entirely, such an induction element can be easily sucked up by a nozzle of a mounting machine. And the protection material 16 protects the coil 13 from getting deformed or hurt by the nozzle. When the protection material 16 is made of an insulating material, it further ensures a reliable insulation between the wires of coil 13. If the protection material 16 is made of a resin that provides a smooth surface condition, it improves the reliability of sucking by a nozzle and the possibility of mounting errors is lowered. Thus a protection material 16 provided on an inductance element remarkably improves the compatibility with mounting machine of a coil-type inductance element; which inductance element, without having the protection material, was the one that did not fit to the machine mounting.

The protection material 16 may be provided in the form of a tube made of a thermo-shrink resin, the tube encasing a body 7. With this concept, the dimensional accuracy is significantly improved, and the reliability in coil protection is also improved. Furthermore, the manufacturing process can be simplified to a reduced rejects rate. A practical method for implementing a protection material of the tube concept is: first prepare a tube of thermo-shrink resin, having a round, square or oval cross sectional shape with a diameter greater than a body 7, encase the body 7 with the tube and then put them into a heat treatment for shrinking. In this way, the tube can be surely provided around the body 7.

Relative dielectric constant of the protection material 16 should preferably be not higher than 6.0, more preferably not higher than 4.0. In the present exemplary embodiment, the protection material 16 is provided covering the four side-surfaces of the body 7, in a manner that the protection material 16 covers substantially the entire coil 13. With the above configuration, the Q factor improves in a case where the protection material used has a relative dielectric constant not higher than 6.0; however, if the protection material has a relative dielectric constant exceeding 6.0, no improvement is seen with the Q factor. Especially in the present embodiment of an inductance element having very small dimensions, wire diameter of the coil 13 goes very small and the Q factor deterioration becomes significant. Thus the relative dielectric constant of the protection material 16 turns out to be a very important factor. Based on the observation, it has been confirmed that the Q factor deterioration can be avoided even with a very small inductance element, by selecting a material whose relative dielectric constant is not higher than 6.0, more preferably not higher than 4.0, for the protection material 16. On the other hand, the relative dielectric constant of protection material 16 should preferably be not lower than 2.0, since paraffin is typically used as a protection material. Since a fluoric resin is a material that can ensure the full functioning of protection material 16, the relative dielectric constant should more preferably be not lower than 2.4. As described in the above, deterioration of Q factor can be avoided by specifically determining the value of relative dielectric constant with the protection material 16, even when the protection material 16 is provided covering the four side-surfaces of the body 7. The protection on the coil 13 is also enhanced.

Figure 9:
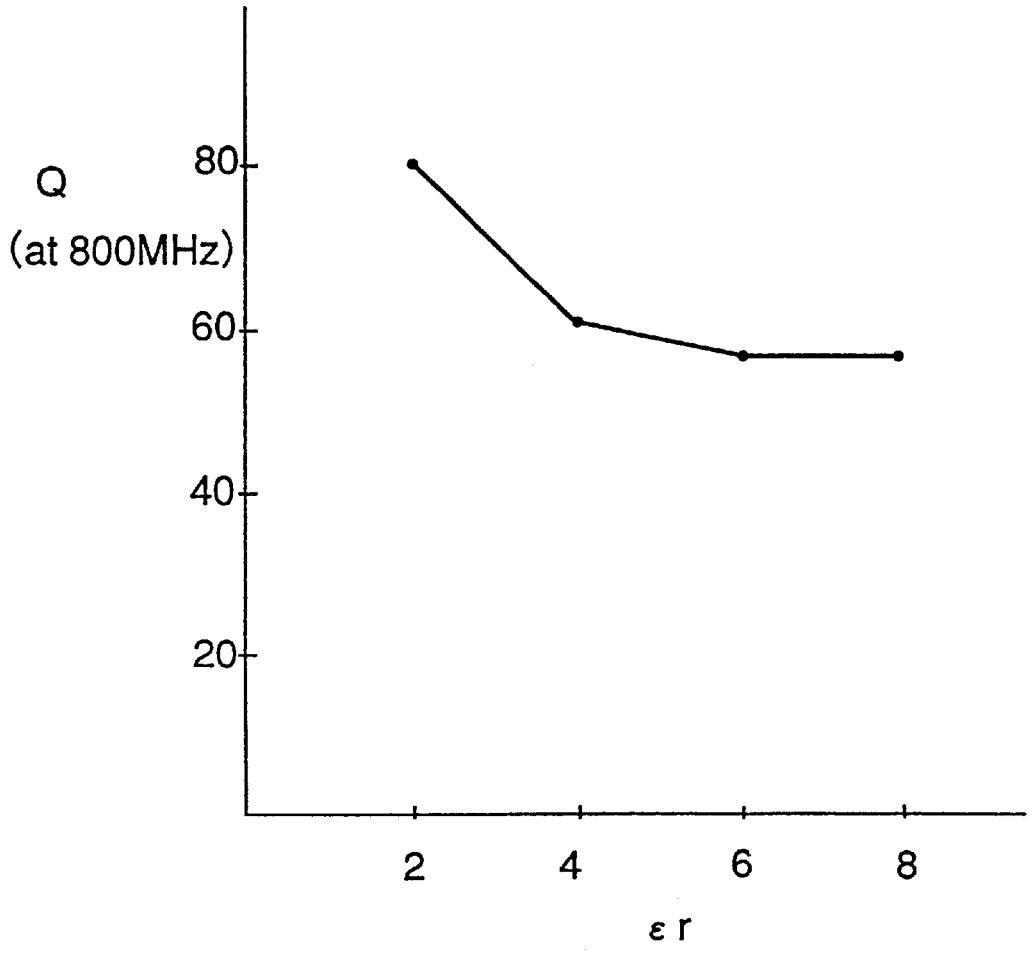
FIG. 9 shows the relationship between relative dielectric constant of protection material and the Q factor in the inductance element.

As shown in FIG. 9, which illustrates the relationship between relative dielectric constant of protection material 16 and the Q factor, no improvement is observed in the Q factor with a protection material 16 having a relative dielectric constant not lower than 6.0. The relationship shown in FIG. 9 represents an inductance element; where the overall dimensions are 1. 6 mm long, 0.8 mm wide, 0.8 mm high, number of turns of coil 13 are 10 turns, body 7 is made of an insulating material containing alumina, thickness of the protection material 16 falls within a range from 70 μm to 80 μm; the relative dielectric constant of protection material 16 is varied by shifting the quantity of adding silica, etc. in the protection material 16.

Figure 5:
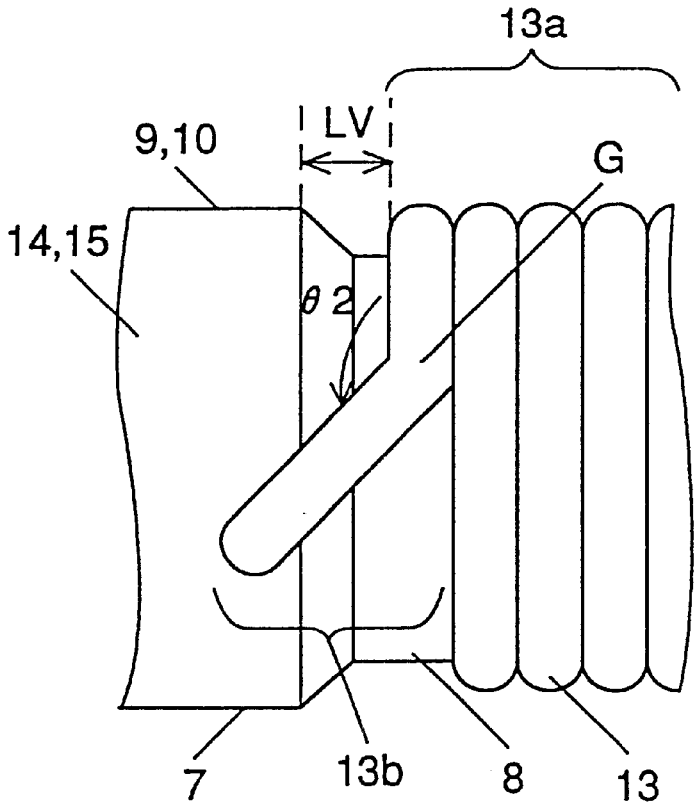
FIG. 5 is a plan view in part showing a state of coiling in the inductance element.

Next, connection between the coil 13 and the terminal section 14, 15 is described. As shown in FIG. 5, the coil 13 consists of a coiled portion 13*a* wound around the winding region 8 and a lead portion 13*b*; a bent point G separating the lead portion 13*b* from the coiled portion 13*a*. The bent point G locates at a border between the coiled portion 13*a* wound normally around the winding region 8 and the lead portion 13*b* which has been taken out of the coil 13 for connection with terminal electrode disposed on the terminal section 14, 15. When bending angle θ2 at the bent point G is determined at 20 degrees14 90 degrees, the coiled portion 13*a* does not slacken, yet the lead portion 13*b* can be efficiently connected with the terminal section 14, 15. More preferred bending angle θ2 is in a range of 35 degrees–55 degrees.

Figure 6:
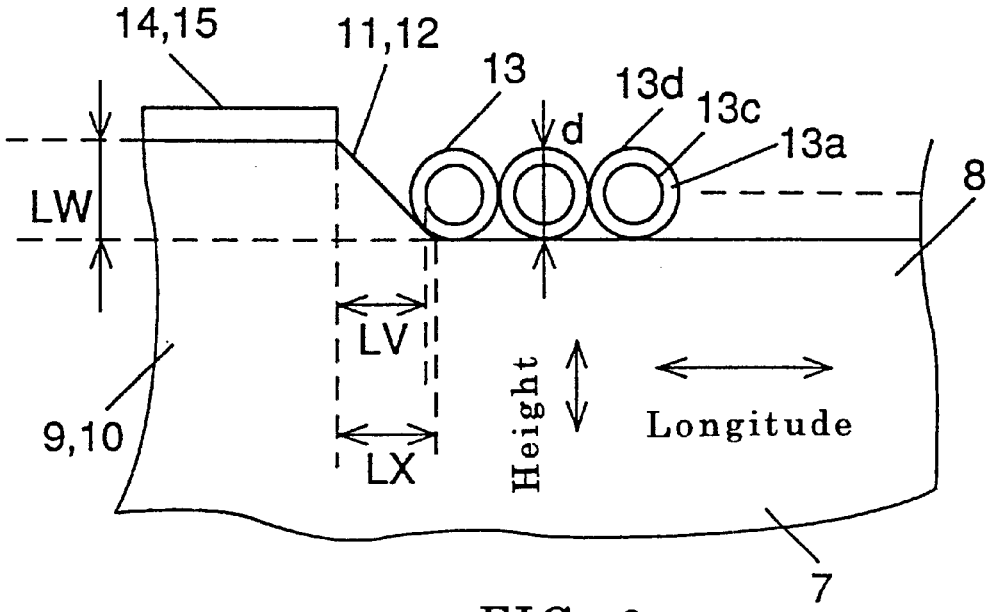
FIG. 6 is a cross sectional view in part used to describe a state of wound coil in the inductance element.

Another point of significance in the present invention is providing a clearance LV for not less than 80 μm, preferably not less than 100 μm, between the outer end of the coiled portion 13*a* and the terminal electrode disposed on the terminal section 14, 15, as illustrated in FIG. 6. By providing a clearance LV for not less than 80 μm, deterioration of the Q factor due to eddy current generated at the terminal electrode can be prevented, and efficiency of an inductance element as a whole can also be prevented from making deterioration. Especially, when the clearance LV is provided for more than 100 μm, the effectiveness in preventing the Q factor deterioration becomes remarkable. The prior art technology referred to earlier also describes about clearance. However, absolutely no teaching is made there about how much the clearance should be. In the present exemplary embodiment of the present invention, it has been confirmed after having made extensive studies that a clearance LV has to be provided for at least 80 μm, taking the reduced overall dimensions of an inductance element into consideration.

Figure 7:
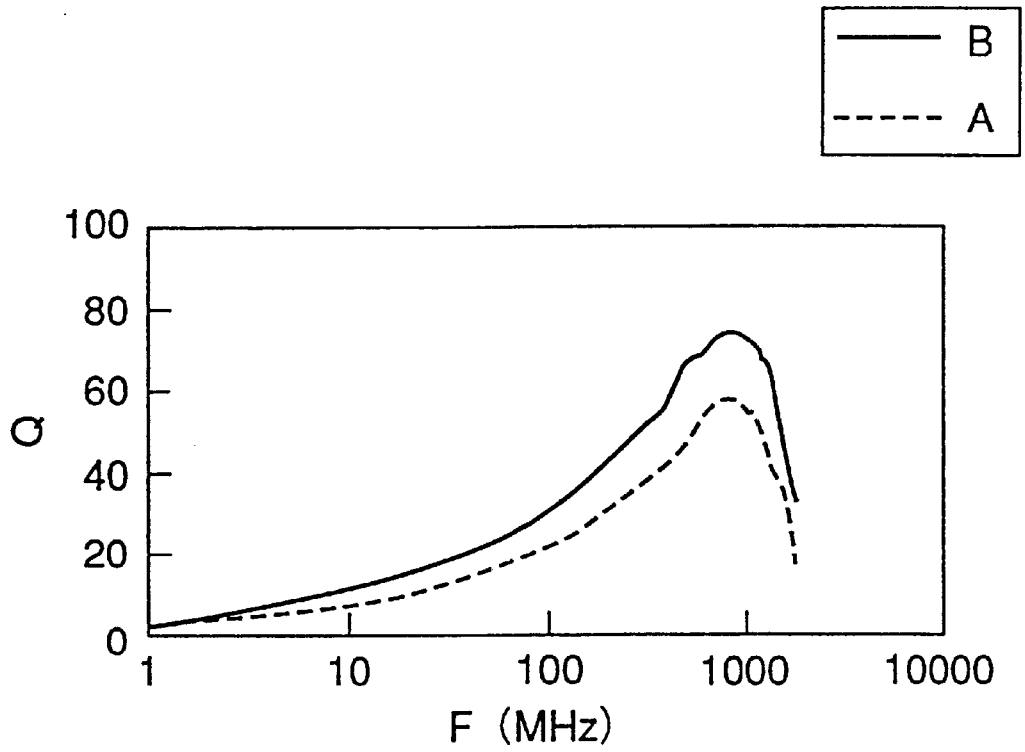
FIG. 7 shows the relationship between frequency and Q factor.

FIG. 7 shows a relationship between frequency and the Q factor. In FIG. 7, dotted line A represents a case where the clearance LV is 34. 2 μm, while solid line B represents a case where the clearance LV is 102.9 μm. The graph tells us that the Q factor goes remarkably high in the high frequency range when a clearance LV is provided for more than 100 μm. After conducting extensive studies, it has been confirmed, as described above, that a clearance LV not less than 80 μm leads to a satisfactory characteristic.

The clearance LV signifies a distance in the direction of length in an inductance element between the outer end of coiled portion 13*a* and the terminal electrode; where, distance in the direction of height is irrelevant. As illustrated in FIG. 6, the coil 13 is provided in most of cases with an insulation coating 13*d* that covers around a coil wire 13*c*. The above-described clearance LV represents a clearance between edge of the coil wire 13*c* at the terminal electrode side and edge of the terminal electrode.

Next, the tapered area 11, 12 is described. The clearance LV not less than 80 μm can be provided by setting a coiling machine to an optimum condition for the value. However, it is not a rare case that coil 13. gets loose and the coiled portion 13*a* moves unusually closer to the terminal electrode, eventually rendering the clearance LV to be less than 80 μm.

In the present embodiment, the tapered area 11, 12 prevents the coiled portion 13*a* from making unusual access to the terminal electrode. Namely, even if the coiled portion 13*a* got loose the tapered area 11, 12 works also as a stopper. Therefore, the coiled portion 13*a* hardly makes unusual approach to the terminal electrode. The clearance LV is thus kept to be not less than 80 μm. The horizontal length LX of the tapered area 11, 12 is determined to be not less than 90 μm, preferably not less than 100 μm. With the above-described configuration, the clearance LV of not less than 80 μm can be well maintained even if wire diameter of the coil 13 is changed within a practically usable range.

Figure 8:
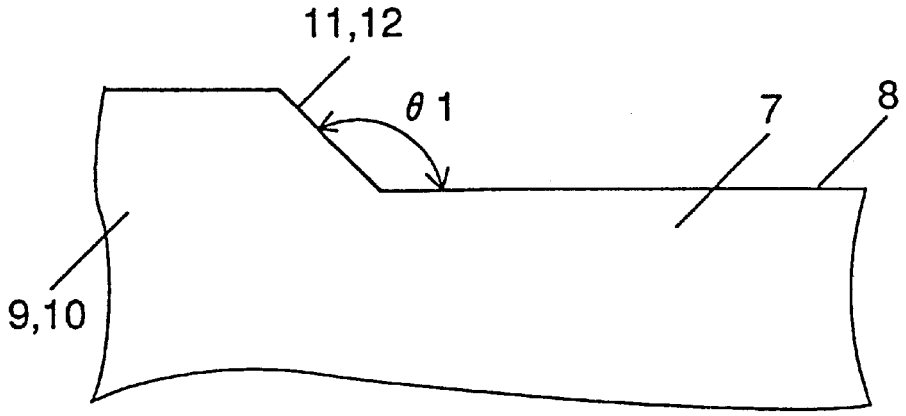
FIG. 8 is a cross sectional view in part used to describe the tapered area of coil winding region in the inductance element.

Preferred angle θ1 for forming the tapered area 11, 12 as shown in FIG. 8 is 100 degrees–170 degrees, more preferably 110 degrees–130 degrees. By determining the angle θ1 to a certain specific value as specified above, a sharp-angled bend is formed neither at the border between the tapered area 11, 12 and the winding region 8, nor at the border between the tapered area 11, 12 and the terminal section 14, 15; yet it sufficiently functions as a stopper.

Referring to FIG. 6, it is preferred that the wire diameter d of coil 13 satisfies the following formula that describes a relationship among the step difference LW in the level between terminal section 14, 15 and winding region 8 and the wire diameter d:

$$(0.5\times\text{step difference LW})<\text{diameter d}<(0.98\times\text{step difference LW})$$

When the above formula is satisfied, the clearance LV of not less than 80 μm is well assured.

Next, a method for manufacturing the inductance element is described.

A body 7 is provided through a dry press, or a pressure molding method. If it is manufactured by a pressure molding, the winding region 8 and the flange 9, 10 are provided by machining it by a cutting or the like process. And then, an under layer 100 is provided covering the entire surface of the flange 9 (in the present exemplary embodiment, the four side-surfaces 9*a* and one end-surface 9*b*), to be further covered thereon with a conductive layer 101*a* using electrolytic plating or the like process. Although the under layer 100 and the conductive layer 101*a* have been formed covering the entire surface of flange 9 in the present embodiment, these layers may be formed instead in different arrangements, taking such factors as the Q factor, the ease of mounting into consideration; for example, covering only the side-surface 9*a*, covering only the end-surface 9*b*, covering only a part of the side-surface 9*a* in a ring arrangement. In the same manner, the flange 10 is provided with the under layer 100 covering the entire surface (in the present exemplary embodiment, the four side-surfaces 10*a* and one end-surface 10*b*), and then the conductive layer 101*a* using electrolytic plating or the like process.

Coil 13 is wound around the winding region 8. Number of coiling turns is determined depending on inductance value and other factors of an inductance element. The Q factor can be raised by winding a coil 13 providing a gap between the adjacent wires. It is preferred to provide a certain specific clearance between the under layer 100, the conductive layer 101*a* and the coil 13, with the exception of end portion of the coil 13.

End portion of the coil 13 is connected to the conductive layer 101*a* using a thermal compression method. Besides the thermal compression, these may be connected by other method; for example, laser welding, spot welding, connection by means of a conductive adhesive made of a solder and a conductive resin.

Protection material 16 is provided on the coil 13; leaving at least the terminal section 14, 15 uncovered. In a case where a tube of heat-shrink material is used for the protection material 16, a body 7 is encased in the tube and then undergo a heat treatment for shrinking.

Conductive layer 101*b* is formed wits a material that does not melt at 260° C. using electrolytic plating or the like plating method, covering the connected portion of coil 13 and conductive layer 101*a*. Under the present structure, where the connected portion of coil 13 and the conductive layer 101*a* is covered by a material of high melting point, the connection is not easily disconnected even if it undergoes a high temperature. Furthermore, strength of the connection is raised to a very high level. Covering the connected portion with a conductive layer 101*b* eases the step of level difference that has been caused by the connection. This contributes to a stable seating of an inductance element on circuit board, and to an increased ease of mounting.

The process steps described so far complete a finished inductance element that does not require a connection layer. For such an inductance element that requires a connection layer, further process steps are needed as follows.

Anti-corrosion layer 102 is formed with Ni, Ti or other anti-corrosion material using a plating or sputtering process, and then a connection surface layer 103 is formed through a plating process over the anti-corrosion layer 102 using a normal solder, a lead-free solder or other conductive material. In the present exemplary embodiment, the connection layer is formed of the anti-corrosion layer 102 and the connection surface layer 103. Depending on the operating environments or other factors, the anti-corrosion layer 102, among the layers forming the connection layer, may be eliminated; however, the connection surface layer 103 is essential. The connection layer provided on the terminal electrode surely enhances the connection strength between the coil 13 and the terminal electrode. The terminal section 14, 15 is thus formed by the terminal electrode and the connection electrode, and a finished inductance element is completed.

Although cross sectional shapes of the flange 9, 10 and the winding region 8 are described in an approximate square in the present exemplary embodiment, these may assume instead a pentagonal, a hexagonal or other polygonal shapes, or they may even take an approximate round cross sectional shape. What is essential is that the cross sectional shape of an inductance element is free from a directional orientation when it is mounted on the surface of a circuit board.

It is preferred that the overall dimensions of an inductance element fall within a range as specified in the following; where height is represented with P1, width with P2 and length with P3, as shown in FIG. 1: 0.4 mm<P1 <1.2 mm, 0.4 mm<P2<1.2 mm, 0.9 mm<P3<2.0 mm. More preferably, 0.7 mm<P1<1.2 mm, 0.7 mm<P2<1.2 mm, 1.5 mm<P3<2.0 mm.

If P1 and P2 are 0.4 mm or less, the body 7 will have a poor mechanical strength, and an inductance element may easily get broken during coil winding; furthermore, certain targeted characteristics may not be provided with a reduced diameter of coil 13. A sharply bent wire of coil 13 readily results in a broken coil 13; and a peeled-off surface coating 13*d*. Therefore, P1 and P2 should preferably be 0.4 mm or more. When they are in excess of 0.7 mm, certainty of the above-described drawbacks may go down a step further. On the other hand, when P1 and P2 are in excess of 1.2 mm, overall size of an element becomes too big and it occupies too much mounting space. This generates a negative factor against the effort for a down-sized circuit board, hence a compact finished apparatus.

If P3 is less than 0.9 mm, number of turns of the coil 13 is limited making it difficult to provide a targeted inductance value. If the number of turns of coil 13 is to be increased, the diameter of wire is compelled to go smaller, such a wire is liable to cause a broken wire when it is wound around the body 7. Therefore, P3 should preferably be greater than 0.9 mm. When it is in excess of 1.5 mm, probability of the above-described drawback is lowered a step further. On the other hand, if P3 is in excess of 2.0 mm, overall size of an element becomes too big and occupies too much mounting space. This generates a negative factor against the effort for a down-sized circuit board, hence a compact finished apparatus.

Although both terminal ends of the coil 13 are put into the connection on the same plane containing a side surface of the body 7 at respective ends Z1 in the present exemplary embodiment as shown in FIG. 1, different arrangements may be considered instead for the connection; for example, one terminal end of the coil 13 is put into the connection on a certain specific side surface of the body 7, while the other terminal end of coil 13 is put into the connection on a side surface opposite to the specific side surface, or on a side surface next to the specific side surface, of the body 7. The inductance value may be optimized, the Q factor may be raised, furthermore the allowance range can be narrowed by selecting a suitable connection arrangement.

Figure 11:
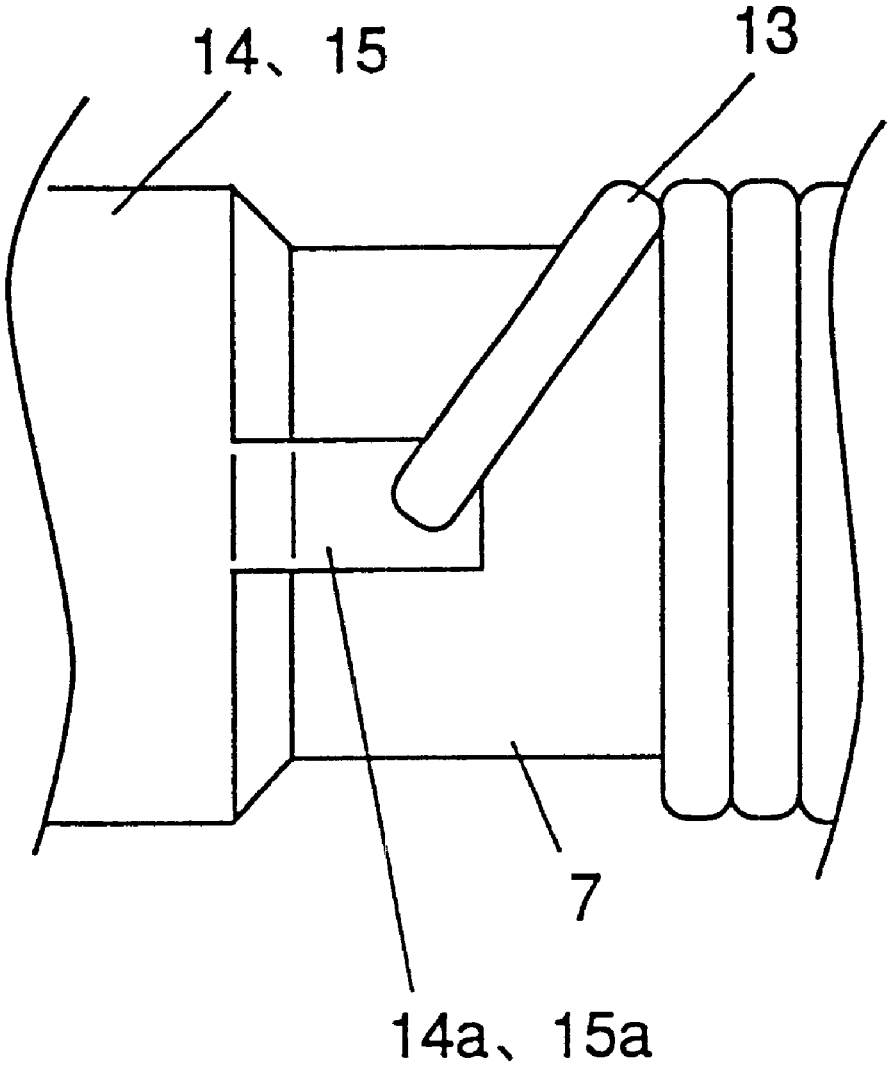
FIG. 11 is a plan view used to describe a state of connection of terminal with coil in the inductance element.
Figure 12:
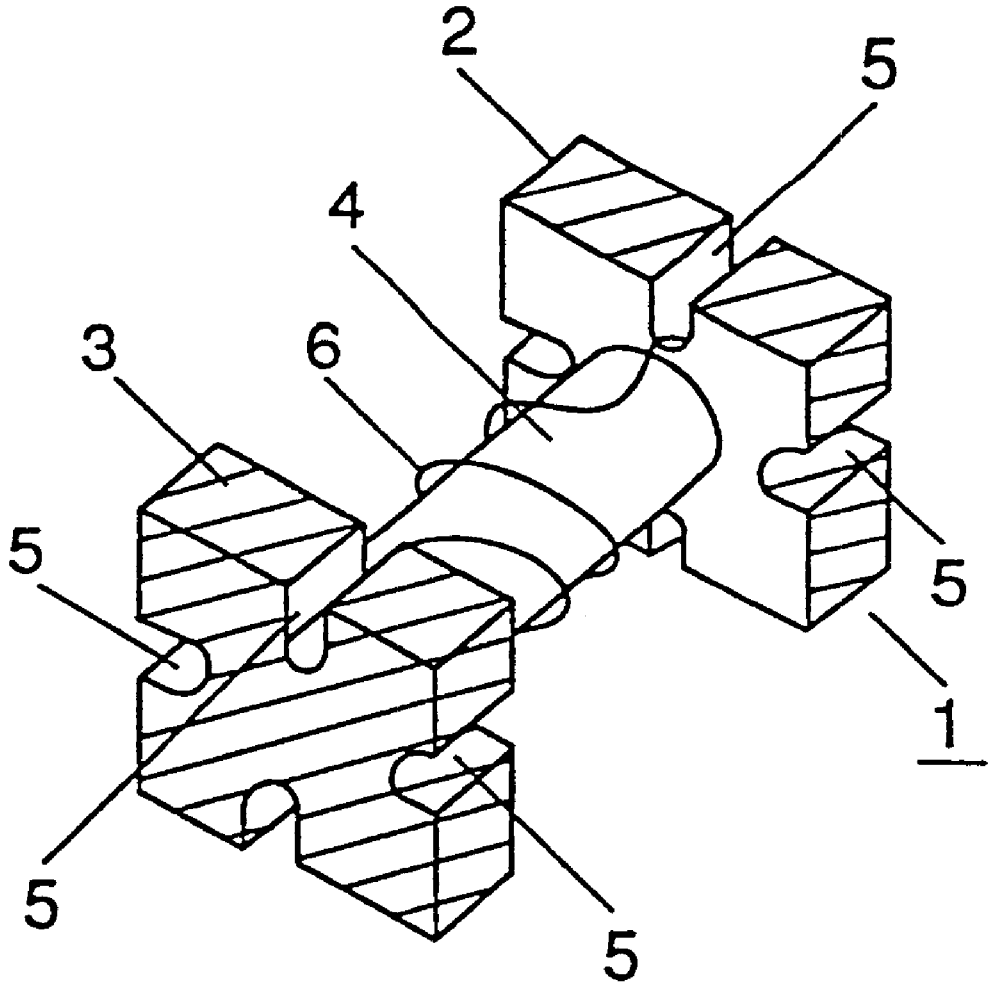
FIG. 12 PRIOR ART
FIG. 12 is a perspective view of a conventional inductance element.

Coil 13 may be connected to the terminal section 14, 15 also in a manner as illustrated in FIG. 11. Namely, a protrusion 14*a*, 15*a* electrically coupled with the terminal section 14, 15 is provided extending towards the middle of the body 7, and the terminal end of coil 13 is connected with the protrusion 14*a*, 15*a* by thermal compression or by means of a connection material. The above-described structure improves the Q factor, and provides a narrower range of tolerance.

Next, description is made on colors of the terminal electrode and the body. The outermost layer of terminal electrode is the connection surface 103, which is silver-colored or white-colored. Although it is not seen in the illustration, the body 7 is partially exposed in the present exemplary embodiment at a place between the protection material 16 covering the coil 13, and the terminal electrode; where, color of the outermost layer of the terminal electrode is made to have a color that is different from that of the protection material 16 and the body 7. Namely, in the present example, the protection material 16 is black, the body 7, at least in its surface, is black, and the outermost layer of the terminal electrode is silver-colored or white-colored. Thus the outermost layer of the terminal electrode is silver-colored or white-colored, whereas the rest is black. This provides a substantial advantage in inspecting and judging the formation width of terminal electrode, and other items, using an image recognition method. A reliable judgement is made available, and the productivity is improved.

Although the protection material 16 and the body 7 have the same color in the present exemplary embodiment, each of which may assume its own color that is different from the color of the outermost layer of the terminal electrode. Although both the body 7 and the protection material 16 are black colored, the respective items may have different colors, such as red, blue or green, in so far as it is different from the color of the outermost layer.

The body 7 may be tinted by mixing a certain specific additive or a pigment. However, if the characteristics became significantly deteriorated as the result of mixture of any additive in the body 7, it is preferred instead to apply paint of a certain specific color on the surface of the body 7.

What is claimed is:

1. An inductance element comprising:

a column shaped body comprising a winding region having a polygonal sectional shape;

a coil wound around said body, said coil comprising a coil wire having a surface covered with an insulation coating;

a first terminal electrode provided on a first end and a side surface of said body and a second terminal electrode provided at a second end and a side surface of said body, said coil being electrically connected to a portion of said first terminal electrode provided on said side surface of said body, said coil being electrically connected to a portion of said second terminal electrode provided on said side surface of said body; and a protection material provided on said body so as to cover at least a portion of said coil, the protection material having a relative dielectric constant not higher than 6.0;

wherein side edges of said winding region are chamfered and, a height, a width and a length of said inductance element satisfy the following criterion, where P1 represents the height of said inductance element, P2 represents the width of the inductance element, and P3 represents the length of the inductance element:

0.4 mm<P1<1.2 mm, 0.4 mm<P2<1.2 mm, and 0.9 mm<P3<2.0 mm.

2. The inductance element of claim 1, wherein specific resistivity of the body is not lower than $10^{11}$ Ωm.

3. The inductance element of claim 1, wherein relative dielectric constant of the body is not higher than 10.0.

4. The inductance element of claim 1, wherein the body is square-column shaped, and one end of the coil is connected to the first terminal electrode on a first side surface of the body, while the other end of the coil is connected to the second terminal electrode on a second side surface of the body different from the first side surface.

5. The inductance element of claim 4, wherein the body is provided in a middle part with a lowered region, level of which region being a step lower in relation to the rest part.

6. The inductance element of claim 1, wherein at least one of the first and second terminal electrodes is provided with a protruding portion extending towards a middle of the body, and the coil is connected with said protruding portion.

7. The inductance element of claim 1, wherein respective outermost layers of the first and second terminal electrodes have a color that is different from that of the body and that of the protection material.

8. The inductance element of claim 7, wherein the body and the protection material are colored identical.

9. The inductance element of claim 8, wherein the body and the protection material are colored black.

10. The inductance element of claim 1, wherein an end of the coil is sandwiched by two conductive layers of the first and second terminal electrodes, one of which conductive layers locating away from the body is formed of a material whose melting point is not lower than 260° C.

11. The inductance element of claim 1, wherein a clearance LV not less than 80 μm is provided between the first and second terminal electrodes and a coiled portion of the coil.

12. The inductance element of claim 11, wherein the body comprises a winding region and flanges provided at both ends of the winding region, and said flanges are provided at the winding region side with a tapered area.

13. The inductance element of claim 1, wherein the coil comprises a coiled portion spirally wound around the body and a lead portion integrally provided between the coiled portion and the first and second terminal electrodes, the lead portion is angled with 90 degrees to 160 degrees in relation to the coiled portion.

14. The inductance element of claim 1, wherein said body is operable for a frequency 100 MHz or higher.

15. The inductance element of claim 1, wherein said protection material has a relative dielectric constant in a range of 2.0 to 4.0.

16. The inductance element of claim 1, wherein the radius of the chamfered side edges is in a range of 0.08 mm to 0.15 mm.

17. The inductance of claim 1, wherein said protection material covers substantially all of an exposed portion of said coil.

18. The inductance element of claim 1, wherein said protection material is not disposed on said first terminal electrode or said second terminal electrode.

* * * * *